US009258848B2

(12) United States Patent
Fukuyama et al.

(10) Patent No.: US 9,258,848 B2
(45) **Date of Patent: *Feb. 9, 2016**

(54) MATRIX-PATTERNED CLOTH

(71) Applicant: NISSAN MOTOR CO., LTD., Yokohama-shi, Kanagawa (JP)

(72) Inventors: Yasuhiro Fukuyama, Yokohama (JP); Takashi Sunda, Sagamihara (JP); Hiroaki Miura, Kamakura (JP); Youji Shimizu, Yamato (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 149 days.

This patent is subject to a terminal disclaimer.

(21) Appl. No.: 13/938,486

(22) Filed: Jul. 10, 2013

(65) Prior Publication Data

US 2014/0014646 A1 Jan. 16, 2014

(30) Foreign Application Priority Data

Jul. 11, 2012 (JP) ..... 2012-155515

(51) Int. Cl.
*H05B 3/06* (2006.01)
*H05B 1/02* (2006.01)
*H05B 3/34* (2006.01)

(52) U.S. Cl.
CPC ..... *H05B 1/0238* (2013.01); *H05B 3/342* (2013.01)

(58) Field of Classification Search
CPC ..... H05B 3/34; H05B 3/342; H05B 3/345; H05B 3/347; H05B 3/56; H05B 3/565; H05B 2203/015; H05B 2203/029; H05B 2203/036; H05B 2203/035; H05B 2203/033; H05B 2203/011; H05B 2203/017; H05B 2203/005; H05B 1/0238; D04B 1/14
See application file for complete search history.

(56) References Cited

U.S. PATENT DOCUMENTS

| | | | | |
|---|---|---|---|---|
| 8,783,903 | B2 | 7/2014 | Bhattacharya et al. | |
| 2010/0013406 | A1 | 1/2010 | Bhattacharya | |
| 2010/0154918 | A1 | 6/2010 | Li et al. | |
| 2013/0264331 | A1 * | 10/2013 | Shimizu et al. | 219/539 |

FOREIGN PATENT DOCUMENTS

JP 2010-144312 A 7/2010

OTHER PUBLICATIONS

USPTO Office Action, U.S. Appl. No. 13/856,078, Nov. 19, 2015, 13 pages.

* cited by examiner

*Primary Examiner* — Shawntina Fugua
(74) *Attorney, Agent, or Firm* — Foley & Lardner LLP

(57) ABSTRACT

A matrix-patterned cloth includes: first and second fiber layers including mutually isolated first and second conductors, respectively; an intermediate fiber layer between the first and second fiber layers; conductive connecting yarns connecting one of the first conductors and one of the second conductors, wherein, when a pressure is applied to the matrix-patterned cloth, each connecting yarn bends so that a position of contact between the connecting yarn and the first or second conductor changes depending on how large the pressure is; a selector; and a heating controller or a resistance measuring unit. The selector scans and sequentially selects one of the first conductors and one of the second conductors. The heating controller applies voltage to intersecting areas where the selected first and second conductors intersect each other via the first and second conductors. The resistance measuring unit measures electric resistances of the intersecting areas via the first and second conductors.

15 Claims, 9 Drawing Sheets

MATRIX-PATTERNED CLOTH

BACKGROUND OF THE INVENTION

1. Field of the Invention

The present invention relates to a matrix-patterned cloth provided on a vehicle seat, for example.

2. Description of the Related Art

Japanese Patent Application Publication No. 2010-144312 discloses a heating textile having a three-layered structure as a cloth heater configured to heat a seat which is installed in a vehicle. This heating textile has conductive yarns in the intermediate layer of the three-layered structure, and is heated by application of electricity to the conductive yarns.

SUMMARY OF THE INVENTION

Since the heating textile is heated by application of electricity to the conductive yarns, the heating textile is suitable when the entire surface of the textile is to be heated. However, it is difficult to selectively heat a part of the entire surface of the heating textile.

An object of the present invention is to provide a matrix-patterned cloth, of which a part of the entire surface can be selectively heated.

A first aspect of the present invention is a matrix-patterned cloth including: a first fiber layer including a plurality of first electric conductors arranged respectively in a plurality of selected first regions in the first fiber layer, and a first insulating part having an electrically insulating property and arranged in a region other than the first regions in the first fiber layer; a second fiber layer including a plurality of second electric conductors arranged respectively in a plurality of selected second regions in the second fiber layer, and a second insulating part having an electrically insulating property and arranged in a region other than the second regions in the second fiber layer; an intermediate fiber layer arranged between the first fiber layer and the second fiber layer, and having a surface in contact with the first fiber layer and a surface in contact with the second fiber layer; a plurality of conductive connecting yarns extending from the surface of the intermediate fiber layer in contact with the first fiber layer to the surface of the intermediate fiber layer in contact with the second fiber layer, and each connecting yarn connecting at least one of the plurality of first electric conductors and at least one of the plurality of second electric conductors, wherein each of the plurality of connecting yarns is arranged such that the connecting yarn bends when a pressure is applied to the matrix-patterned cloth in a thickness direction thereof, and such that at least one of a position of contact between the connecting yarn and the corresponding first electric conductor, and, a position of contact between the connecting yarn and the corresponding second electric conductor, changes depending on how large the pressure is; a selector configured to scan and sequentially select at least one of the plurality of first electric conductors and at least one of the plurality of second electric conductors, and to set areas, in which the selected first electric conductors and the selected second electric conductors intersect each other when viewed in the thickness direction, as intersecting areas; and at least one of a heating controller and a resistance measuring unit, the heating controller configured to apply a voltage to the intersecting areas via the first and second electric conductors selected by the selector, and the resistance measuring unit configured to measure electric resistances of the intersecting areas via the first and second electric conductors selected by the selector.

A second aspect of the present invention is a method of heating a matrix-patterned cloth, including: providing a matrix-patterned cloth including: a first fiber layer including a plurality of first electric conductors arranged respectively in a plurality of selected first regions in the first fiber layer, and a first insulating part having an electrically insulating property and arranged in a region other than the first regions in the first fiber layer; a second fiber layer including a plurality of second electric conductors arranged respectively in a plurality of selected second regions in the second fiber layer, and a second insulating part having an electrically insulating property and arranged in a region other than the second regions in the second fiber layer; an intermediate fiber layer arranged between the first fiber layer and the second fiber layer, and having a surface in contact with the first fiber layer and a surface in contact with the second fiber layer; and a plurality of conductive connecting yarns extending from the surface of the intermediate fiber layer in contact with the first fiber layer to the surface of the intermediate fiber layer in contact with the second fiber layer, and each connecting yarn connecting at least one of the plurality of first electric conductors and at least one of the plurality of second electric conductors, wherein each of the plurality of connecting yarns is arranged such that the connecting yarn bends when a pressure is applied to the matrix-patterned cloth in a thickness direction thereof, and such that at least one of a position of contact between the connecting yarn and the corresponding first electric conductor, and, a position of contact between the connecting yarn and the corresponding second electric conductor, changes depending on how large the pressure is; scanning and sequentially selecting at least one of the plurality of first electric conductors and at least one of the plurality of second electric conductors; setting areas, in which the selected first electric conductors and the selected second electric conductors intersect each other when viewed in the thickness direction, as intersecting areas; and applying a voltage to the intersecting areas via the selected first and second electric conductors.

BRIEF DESCRIPTION OF THE DRAWINGS

The invention will now be described with reference to the accompanying drawings wherein.

DESCRIPTION OF THE EMBODIMENTS

Descriptions will be provided for embodiments of the present invention on the basis of the drawings. Terms indicating directions, such as "upper" and "lower," in the following description are defined, for the sake of convenience, to explain positional relationships among the components. These directional expressions do not impose restriction on an orientation in which the apparatus is actually attached.

First Embodiment

Figure 1:
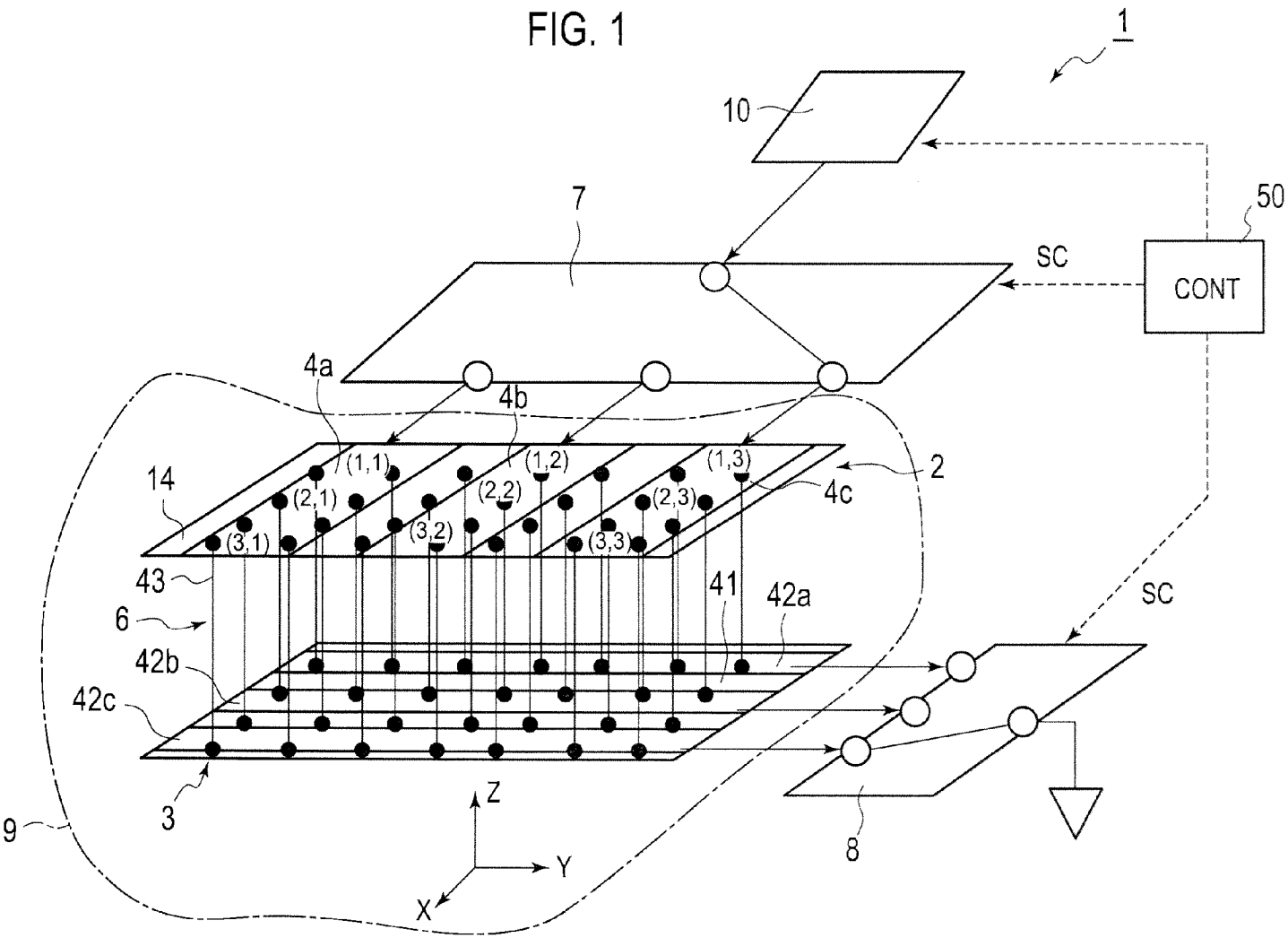
FIG. 1 is an exploded perspective view schematically showing a matrix-patterned cloth of a first embodiment of the present invention.

An example in which a matrix-patterned cloth is used as a cloth heater configured to heat a vehicle seat by being installed in the vehicle seat will be described in a first embodiment. FIG. 1 is an exploded perspective view schematically showing a configuration of a matrix-patterned cloth 1 of the first embodiment of the present invention.

As shown in FIG. 1, the matrix-patterned cloth 1 includes: a cloth portion 9; a column scan selector 7 configured to select a column position of an area on the cloth portion 9; a row scan selector 8 configured to select a row position of the area on the cloth portion 9; and a heat generation controller (heating controller) 10 configured to output a voltage in order to heat the area corresponding to the column position and the row position selected by the column scan selector 7 and the row scan selector 8.

The cloth portion 9 has a three-layered structure, and includes: an upper layer (a first fiber layer) 2; a lower layer (a second fiber layer) 3; and an intermediate layer (an intermediate fiber layer) 6 provided between the upper layer 2 and the lower layer 3. The intermediate layer 6 has a surface in contact with the upper layer 2 and a surface in contact with the lower layer 3.

The upper layer 2 includes: multiple belt-shaped conductive parts (first electric conductors; three electric conductors 4*a* to 4*c* in the case shown in FIG. 1) spaced out from one another; and non-conductive parts (first insulating parts) 14 having electrically insulating properties. The multiple conductive parts 4*a* to 4*c* each extend in the column direction (the X-direction in FIG. 1), and are arranged in parallel to one another while spaced out from one another in the row direction (the Y-direction in FIG. 1) (in a state of being electrically insulated from one another in the upper layer 2). The non-conductive parts 14 are placed in areas other than the areas in which the multiple conductive parts are placed in the upper layer 2.

The lower layer 3 includes: multiple belt-shaped conductive parts (second electric conductors; three electric conductors 42*a* to 42*c* in the case shown in FIG. 1) spaced out from one another; and non-conductive parts (second insulating parts) 41 having electrically insulating properties. The multiple conductive parts 42*a* to 42*c* each extend in the row direction (the Y-direction in FIG. 1), and are arranged in parallel to one another while spaced out from one another in the column direction (the X-direction in FIG. 1) (in a state of being electrically insulated from one another in the lower layer 3). The non-conductive parts 41 are placed in areas other than the areas in which the multiple conductive parts are placed in the lower layer 3.

The multiple conductive parts 4*a* to 4*c* provided in the upper layer 2 are formed in a way that, in a plan view (when observed in the thickness direction of the cloth portion 9 (in the Z-direction in FIG. 1)), the multiple conductive parts 4*a* to 4*c* are substantially orthogonal to the multiple conductive parts 42*a* to 42*c* provided in the lower layer 3.

Accordingly, each of the areas (hereinafter referred to as "intersecting areas") in which the conductive parts 4*a* to 4*c* provided in the upper layer 2 and the conductive parts 42*a* to 42*c* provided in the lower layer 3 intersect with one another in the plan view can be expressed with coordinates, the first number of which represents one of the three columns in the upper layer 2, and the other of which represents one of the three rows in the lower layer 3. To put it specifically, as shown in FIG. 1, a total of 9 intersecting areas (1, 1) to (3, 3) can be defined. For example, the coordinates of the intersecting area in which the conductive part 4*a* and the conductive part 42*a* intersect each other is defined as (1, 1).

Figure 5:
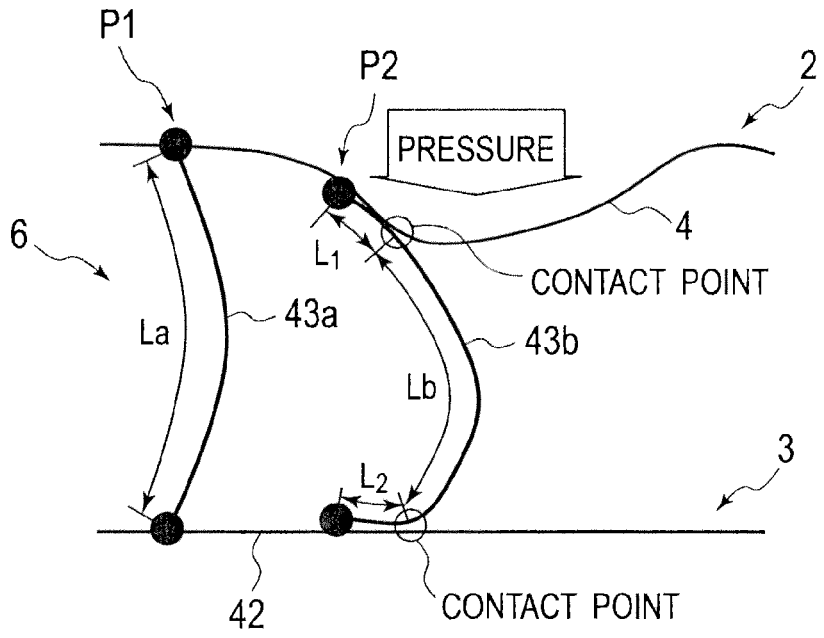
FIG. 5 is an explanatory diagram related to the second embodiment, and showing how connecting yarns bend due to pressure.

The intermediate layer 6 is formed from a large number of connecting yarns 43. Each connecting yarn 43 extends in a direction substantially orthogonal to the upper layer 2 and the lower layer 3 (in the thickness direction). The upper end portion of each connecting yarn 43 is in contact with the upper layer 2, and the lower end portion of the connecting yarn 43 is in contact with the lower layer 3. In addition, the connecting yarns 43 bend as shown in FIG. 5 when pressure is applied to the cloth portion 9 in the vertical direction (the thickness direction). Thereby, the substantial length from the contact point of each connecting yarn 43 with the upper layer 2 to the contact point of the connecting yarn 43 with the lower layer 3 becomes shorter. This will be described in detail later.

The column scan selector 7 includes a switching element configured to select one of the three conductive parts 4*a* to 4*c* provided in the upper layer 2 on the basis of a selection control signal SC supplied from a matrix-patterned cloth controller 50. The row scan selector 8 includes a switching element configured to select one of the three conductive parts 42*a* to 42*c* provided in the lower layer 3 on the basis of the selection control signal SC supplied from the matrix-patterned cloth controller 50. A stepping relay or the like may be used as the switching element. Accordingly, a desired set of coordinates can be selected from the coordinates (1, 1) through to the coordinates (3, 3) by selecting one conductive part by use of the column scan selector 7 and selecting one conductive part by use of the row scan selector 8.

When a preset intersecting area is selected by the column scan selector 7 and the row scan selector 8, the heat generation controller 10 takes control to feed electricity to the intersecting area by applying a voltage to the selected conductive parts, and thus to make the connecting yarn 43 in the intersecting area generate heat. The control procedure will be described in detail later.

In this respect, the cloth portion 9 can be formed as a three-dimensional double raschel knit fabric, a representative example of which is Fusion (trademark) of Asahi Kasei Fibers Corporation. In addition, the conductive parts 4*a* to 4*c* in the upper layer 2, the conductive parts 42*a* to 42*c* in the lower layer 3, and the connecting yarns 43 are made from an electrically conductive material. Examples of the electrically conductive material include: metal lines made of gold, silver, copper, a nickel chromium alloy, and the like; particles of a carbon-based material such as carbon or graphite, a metal, and a semiconductor such as a metal oxide; and fibers containing conductive polymers (conductive polymer fibers) such as acetylene-based, five-membered heterocyclic, phenylene-based, and aniline-based fibers. This formation makes it possible to enhance the fiber strength while keeping the conductivity. For this reason, the cloth portion 9 is capable of deformation with flexibility to some extent when pressure is applied thereto, and is capable of generating heat when electricity is applied thereto.

Examples of the carbon-based material include: a commercially available fiber material made of carbon such as TORAYCA (trademark) of Toray Industries, Inc. or DONACARBO (trademark) of Osaka Gas Chemicals Co., Ltd.; fibers spun from a material containing carbon fibers or carbon powder; and the like.

On the other hand, examples of particles used as the conductive material include: carbon-based powder such as carbon black and Ketjen black; carbon-based fibers; metal fine particles such as iron, aluminum, and like; and semiconductor fine particles such, as tin dioxide ($SnO_2$), zinc oxide (ZnO), and the like. It is possible to use a conductive material made solely from any one of these materials; a conductive material prepared by depositing or coating any one of these materials on its surface; a conductive material prepared by using any one of these materials as its core while coating its surface with another material; and the like. For example, a conductive material prepared by coating a surface of a conductive fiber serving as a core with another polymer, and a conductive material prepared by coating a surface of a fiber serving as a core with a conductive material, may be used. The use of any of these conductive materials can enhance the fiber strength.

From viewpoints of market availability and specific gravity, it is desirable to use the carbon fiber or the carbon powder among these materials. No specific restrictions are imposed as to whether the conductive material is made from a single material or from multiple materials.

In addition, the material of the conductive parts 4*a* to 4*c* in the upper layer 2 and the conductive parts 42*a* to 42*c* in the lower layer 3 is not limited to the fiber-like material but may be made by applying conductive coating or the like uniformly onto each layer. Examples of the conductive coating include DOTITE (trademark) of Fujikura Kasei Co., Ltd.

Furthermore, general fibers are used for the non-conductive parts 14 in the upper layer 2 and the non-conductive parts 41 in the lower layer 3. From viewpoints of costs and practicality, it is desirable that such general fibers use one type or a combination of types of fibers made from general-purpose resins including: polyamides such as nylon 6 and nylon 66; polyethylene terephthalates; polyethylene terephthalates containing copolymerized components; polybutylene terephthalates; polyacrylonitriles; and the like.

When the conductive polymer fibers are used for the connecting yarns 43 of the intermediate layer 6, it is desirable to set the range of the electrical resistivity of the conductive polymer fibers from $10^{-3}$ to $10^{2}$ [Ω·cm] in order to obtain a sufficient heat generating function. The reason is that, when the conductive polymer fibers are made by weaving or knitting, the conductive parts 4, 42 generate heat if the resistance of the conductive polymer fibers functioning as a resister is too small, and it is then difficult to warm an arbitrarily limited area alone. On the other hand, if the electrical resistivity of the conductive polymer fibers is too large, less current flows for heat generation and a sufficient amount of heat cannot be obtained. When the resistivity is set from $10^{-2}$ to $10^{1}$ [Ω·cm] as a more desirable range, it is possible to achieve the heat generating function of the intermediate layer 6 more efficiently.

Figure 2:
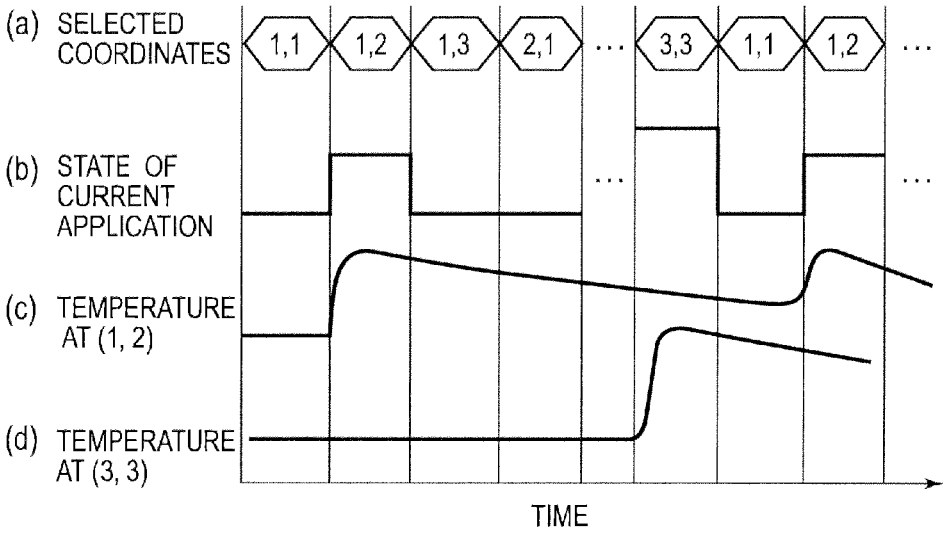
FIG. 2 is a timing chart showing how the matrix-patterned cloth of the first embodiment of the present invention works.

Next, referring to a timing chart shown in FIG. 2, descriptions will be provided for how the matrix-pattern cloth of the present embodiment works. In this embodiment, as shown in FIG. 2 (*a*), intersecting areas defined by the coordinates are sequentially selected and shifted from one to another (scanned through) in time series. When an intersecting area corresponding to the heating target is selected, the intersecting area is supplied with electric current. Thereby, a portion of the intermediate layer 6 corresponding to the intersecting area is heated. Detailed descriptions will be provided below.

Once the selection control signal SC outputted from the matrix-patterned cloth controller 50 is supplied to the column scan selector 7 and the row scan selector 8, the conductive part (4*a* to 4*c*) selected by the column scan selector 7 and the conductive part (42*a* to 42*c*) selected by the row scan selector 8 are sequentially selected and shifted from one to another in time series. Thereby, as shown in FIG. 2 (*a*), the intersecting areas are sequentially selected in a scanning manner in the following order: the coordinates (1, 1), the coordinates (1, 2), . . . , and the coordinates (3, 3). When a set of coordinates corresponding to an area in the cloth portion 9 to be heated is selected, the heat generation controller 10 supplies electric current to the corresponding conductive parts. In the example shown in FIG. 2, the intersecting areas respectively corresponding to the coordinates (1, 2) and the coordinates (3, 3) are supplied with electric current (see FIG. 2 (*b*)).

As shown in FIG. 2 (*c*), when the coordinates (1, 2) are selected, the conductive part 4*b* and the conductive part 42*a* (see FIG. 1) corresponding to the coordinates (1, 2) are supplied with electric current. Thereby, the current flows through the connecting yarn 43 of the intermediate layer 6 corresponding to this intersecting area, and the connecting yarn 43 generates heat. In other words, the intersecting area corresponding to the coordinates (1, 2) is heated. Accordingly, as shown in FIG. 2 (*c*), the temperature rises in the area of the intermediate layer 6 corresponding to the coordinates (1, 2). Similarly, as shown in FIG. 2 (*d*), the temperature rises in the area of the intermediate layer 6 corresponding to the coordinates (3, 3). In this example, as shown in FIG. 2 (*b*), the current applied to the coordinates (1, 2) and the current applied to the coordinates (3, 3) are different from each other in such a way that the current applied to the coordinates (3, 3) is set larger than the current applied to the coordinates (1, 2). Accordingly, the area of the intermediate layer 6 corresponding to the coordinates (3, 3) is heated to a higher temperature than that of the area of the intermediate layer 6 corresponding to the coordinates (1, 2).

Thus, of the multiple intersecting areas set in the form of a matrix, the temperatures of the intersecting areas intended to be heated can be increased by applying the currents only to the intersecting areas. Furthermore, it is possible to control the level of the temperature at the time of heating by changing the amount of the current at the time of current application.

The foregoing descriptions have been provided for the embodiment in which, as shown FIG. 2 (*a*), the intersecting areas corresponding to all of the coordinates (1, 1), the coordinates (1, 2), . . . , and the coordinates (3, 3) are sequentially selected. Instead, it is possible to select and supply electric current only to the intersecting areas of the heating targets.

Figure 3:
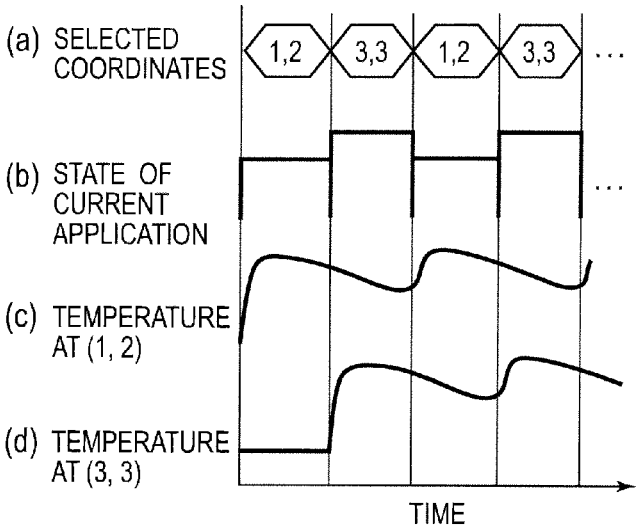
FIG. 3 is a timing chart showing how a matrix-patterned cloth of a modification of the first embodiment of the present invention works.

FIG. 3 is a timing chart showing the procedures of a process for selecting and supplying electric current only to the intersecting areas of the heating targets. As shown in FIG. 3 (*a*), only the coordinates (1, 2) and the coordinates (3, 3) are alternately selected. Each time either the coordinates (1, 2) or the coordinates (3, 3) are selected, electric current is supplied (see FIG. 3 (*b*)) and the connecting yarns 43 of the intermediate layer 6 corresponding to the coordinates (1, 2) and the coordinates (3, 3) are made to generate heat. As a result, the intersecting area corresponding to the coordinates (1, 2) can be heated as shown in FIG. 3 (*c*) while the intersecting area corresponding to the coordinates (3, 3) can be heated as shown in FIG. 3 (*d*). It should be noted that in this case, the currents are controlled such that the current flowing upon selection of the coordinates (3, 3) is larger than the current flowing upon selection of the coordinates (1, 2). As a consequence, the temperature in the selected area corresponding to the coordinates (3, 3) is higher at the time of heating.

In the matrix-patterned cloth 1 of the first embodiment, as described above, the cloth 9 as a whole is divided into the multiple columns (the three columns in the embodiment) and the multiple rows (the three rows in the embodiment), the areas in which selected columns and selected rows intersect one another are defined as the intersecting areas, and the voltage output by the heat generation controller 10 can be controlled so that only the connecting yarns 43 in the selected desired intersecting areas are supplied with electric current.

In addition, since the connecting yarns 43 provided in the intermediate layer 6 are electrically connected to the conductive parts in the upper layer 2 and the conductive parts in the lower layer 3, only an area in the intermediate layer 6 corresponding to the intersecting area supplied with electric current generates heat, and a region in the cloth portion 9 corresponding to this intersecting area is heated. Accordingly, when an area to be supplied with electric current by the heat generation controller 10 is set as appropriate, a desired area in the entire area of the cloth portion 9 can be selectively heated.

The foregoing descriptions have been provided for the embodiment in which: the three conductive parts 4*a* to 4*c* are provided in the upper layer 2; the three conductive parts 42*a* to 42*c* are provided in the lower layer 3; and the cloth portion 9 as a whole is divided into a matrix of three rows and three columns. However, the present invention is not limited to this embodiment. Multiple rows other than the three rows and multiple columns other than the three columns may be set in the matrix.

In addition, the foregoing descriptions have been provided for the embodiment in which the two intersecting areas corresponding to the coordinates (1, 2) and the coordinates (3, 3) are heated. In the present invention, however, the areas to be heated are not limited to two intersecting areas. One or more intersecting areas may be set and heated as needed.

Furthermore, the foregoing descriptions have been provided for the embodiment in which the conductive parts 4*a* to 4*c* (the first electric conductors) and the conductive parts 42*a* to 42*c* (the second electric conductors) are arranged orthogonal to each other. However, the meaning of the term "intersect" used in the present invention is not limited to intersection at a right angle, but also includes intersection at some other angle.

Moreover, the foregoing descriptions have been provided for the embodiment in which: the column scan selector 7 selects (scans through) the conductive parts provided in the upper layer 2 sequentially, one by one in the scanning manner; and the row scan selector 8 selects (scans through) the conductive parts provided in the lower layer 3 sequentially, one by one in the scanning manner. However, each of the selectors 7, 8 may be configured to sequentially select multiple conductive parts at each time in the scanning manner. The selection of multiple conductive parts makes it possible to increase the frequency of current application.

Second Embodiment

Next, descriptions will be provided for a matrix-patterned cloth of a second embodiment of the present invention. In the second embodiment, the resistances of connecting yarns 43 provided in the intermediate layer 6 of the matrix-patterned cloth are measured, and it is thereby detected which region in the entire cloth portion a pressure is applied to. In other words, the second embodiment is a case where the matrix-patterned cloth is used as a pressure-sensitive sensor. Detailed descriptions will be provided below.

Figure 4:
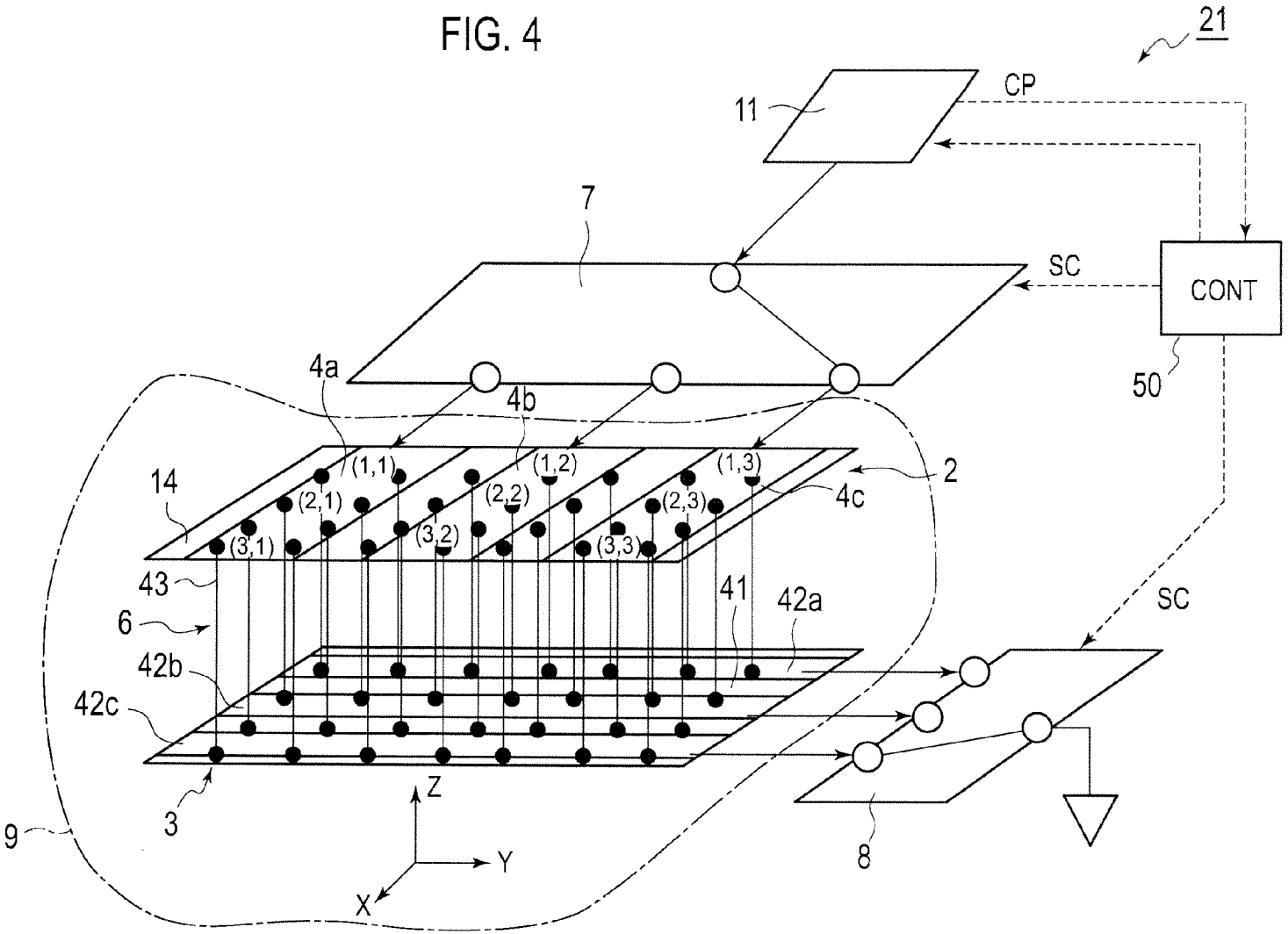
FIG. 4 is an exploded perspective view schematically showing a matrix-patterned cloth of a second embodiment of the present invention.

FIG. 4 is an exploded perspective view schematically showing a configuration of a matrix-patterned cloth 21 of the second embodiment of the present invention. As shown in FIG. 4, the matrix-patterned cloth 21 includes: the cloth portion 9; the column scan selector 7 configured to select a column position of an area on the cloth portion 9; the row scan selector 8 configured to select a row position of the area on the cloth portion 9; and a pressure detection controller (a pressed state detector) 11 configured to detect a pressure applied to the area corresponding to the column position and the row position which are selected by the column scan selector 7 and the row scan selector 8.

Since the cloth portion 9 has the same configuration as the cloth portion 9 of the first embodiment (see FIG. 1) described above, the same components will be denoted by the same reference signs, and descriptions of the configuration will be omitted. In addition, since the column scan selector 7 and the row scan selector 8 also have the same configurations as those of the first embodiment described above, descriptions of their configurations will be omitted.

When one of the three conductive parts 4*a* to 4*c* provided in the upper layer 2 and one of the three conductive parts 42*a* to 42*c* provided in the lower layer 3 are selected, the pressure detection controller 11 performs control such that: a voltage is applied to the selected pair of conductive parts; a resistance is measured on the basis of a relationship between the voltage and a current which flows when the voltage is applied; and the pressure is detected on the basis of the measured resistance. In other words, when the pressure is applied to the cloth portion 9, the matrix-patterned cloth 21 of the second embodiment can be used as a pressure-sensitive sensor configured to detect which area the pressure is applied to. In addition, the pressure detection controller 11 functions as a resistance measurement unit configured to measure the resistance of the intersecting area.

Figure 6:
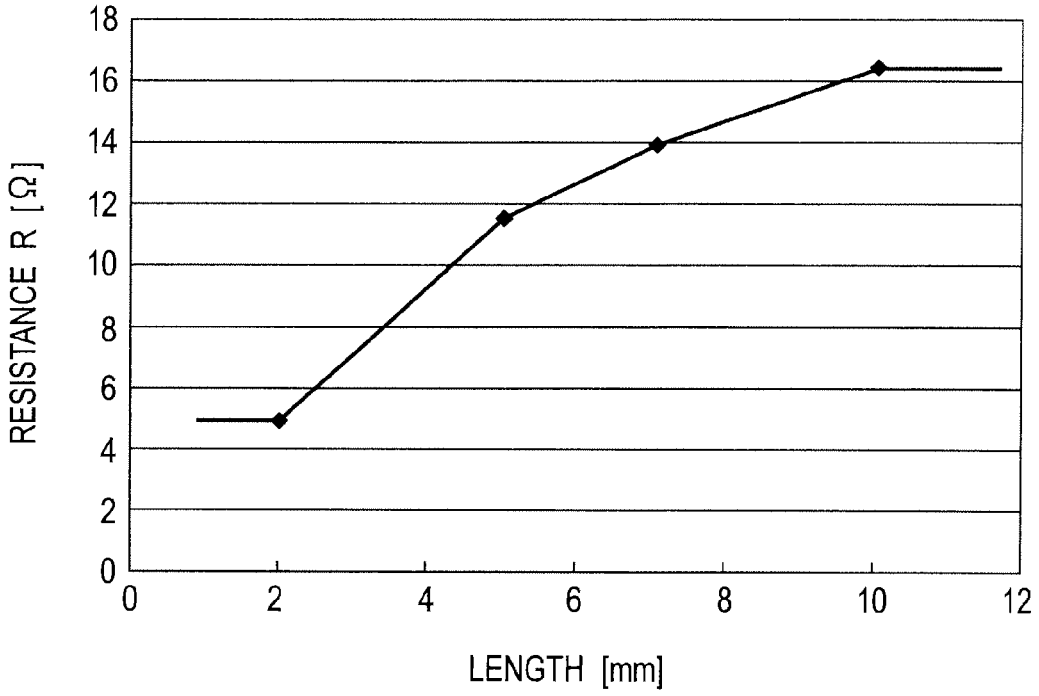
FIG. 6 is a characteristic diagram related to the second embodiment, and showing a relationship between the length and resistance value of a connecting yarn.
Figure 7:
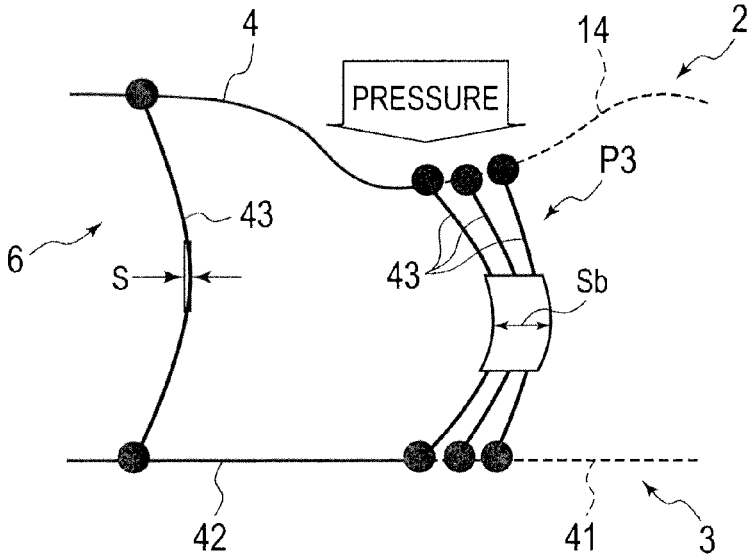
FIG. 7 is an explanatory diagram related to the second embodiment, and showing how multiple connecting yarns come into contact with one another in the horizontal direction due to pressure.

Referring to FIG. 5 to FIG. 7, descriptions will be hereinbelow provided for a principle with which the matrix-patterned cloth 21 functions as the pressure-sensitive sensor. As described above, the multiple conductive connecting yarns 43 each extending from the upper layer 2 to the lower layer 3 are provided in the intermediate layer 6 between the upper layer 2 and the lower layer 3. In addition, for example, when the pressure is applied to the upper surface of the cloth portion 9 in the thickness direction, the electric resistance of each connecting yarn 43 varies in an analog manner in accordance with the applied pressure. FIG. 5 is an explanatory diagram schematically showing: how the intermediate layer 6 is compressed and deformed when the pressure is applied to the cloth portion 9; and in addition to its two end portions, how other parts of one of the connecting yarns 43 are brought into contact with one of the conductive parts 4 in the upper layer 2 and one of the conductive parts 42 in the lower layer 3, respectively.

As shown in FIG. 5, a connecting yarn 43*a* in an area P1 to which no pressure is applied stands independently between the corresponding conductive part 4 in the upper layer 2 and the corresponding conductive part 42 in the lower layer 3 without bringing its parts, except for its two end portions, into contact with any one of the conductive parts 4, 42. Thereby, the connecting yarn 43*a* keeps its length between the contact points at a length La. Once the pressure is applied to the upper surface of the upper layer 2 from above, as shown in FIG. 5, a connecting yarn 43*b* in an area P2 to which the pressure is applied bends (the curvature radius is decreased) more than the connecting yarn 43*a*. In addition, a range of the upper end portion of the connecting yarn 43*b* of a predetermined length $L_1$, or a point which is located away from the upper end portion thereof by the predetermined length $L_1$ is brought into direct contact with the corresponding conductive part 4 in the upper layer 2. Furthermore, a range of the lower end portion of the connecting yarn 43*b* of a predetermined length $L_2$, or a point which is located away from the lower end portion thereof by the predetermined length $L_2$ is brought into direct contact with the corresponding conductive part 42 in the lower layer 3. Accordingly, the substantial length between the contact points of the connecting yarn 43*b* becomes equal to Lb (Lb<La). For this reason, the electric resistance of the connecting yarn 43*b* becomes smaller than that of the connecting yarn 43*a*.

FIG. 6 is a characteristic diagram showing a relationship between the length L [mm] and the resistance [Ω] of the connecting yarn 43. As shown in FIG. 6, the electric resistance of the connecting yarn 43 varies in such a way that the electric resistance of the connecting yarn 43 becomes smaller as the length L thereof becomes shorter. In other words, the measurement of the electric resistance makes it possible to find the degree of deformation of the connecting yarn 43 provided in a given area, and to detect the pressure applied to the area.

In this embodiment, the relationship between the length L [mm] of the connecting yarn 43 and the pressure P [Pa] applied to the cloth portion 9 is expressed with $$L=\alpha P \tag{1}$$

where α [mm/Pa] represents a coefficient which is a value substantially corresponding to an inverse number of a spring constant in the compression direction of the cloth portion 9. The relationship between the length L and the resistance R is expressed with $$R=\rho L/S \tag{2}$$

where R represents the resistance [Ω]; ρ, the resistivity [Ω·mm]; L, the length [mm]; and S, the cross-sectional area [$mm^2$].

When the pressure is applied, the length L becomes shorter as shown by the length La changing into the length. Lb in FIG. 5, for example. Additionally, when the pressure is applied, multiple connecting yarns 43 come into contact with one another at regions (central regions, for example) other than the two end portions of the connecting yarns 43 and are electrically connected to one another as shown in the region P3 in FIG. 7. Accordingly, the cross-sectional area S of the connecting yarn 43 is increased to a cross-sectional area Sb (Sb>S). For this reason, the value of the resistance R becomes smaller.

The actual change in the resistance R of the connecting yarns 43 does occur in an independent manner. Rather, the actual change occurs while the connecting yarns 43 are deformed continuously at the same time. The resistance of the aggregate of the connecting yarns 43 also changes as shown in FIG. 6. For this reason, the multiple connecting yarns 43 are capable of functioning as the pressure-sensitive sensor for each intersecting area. Data on the characteristic shown in FIG. 6 is stored in a storage unit of the pressure detection controller 11. An output (a change in the resistance value) CP from the pressure-sensitive sensor is sent from the pressure detection controller 11 to the matrix-patterned cloth controller 50.

For the purpose of increasing sensitivity of the pressure-sensitive sensor, it is desirable that the conductive parts 4*a* to 4*c*, 42*a* to 42*c* shown in FIG. 4 use a material whose resistivity is lower than that of the connecting yarns 43 of the intermediate layer 6.

Figure 8:
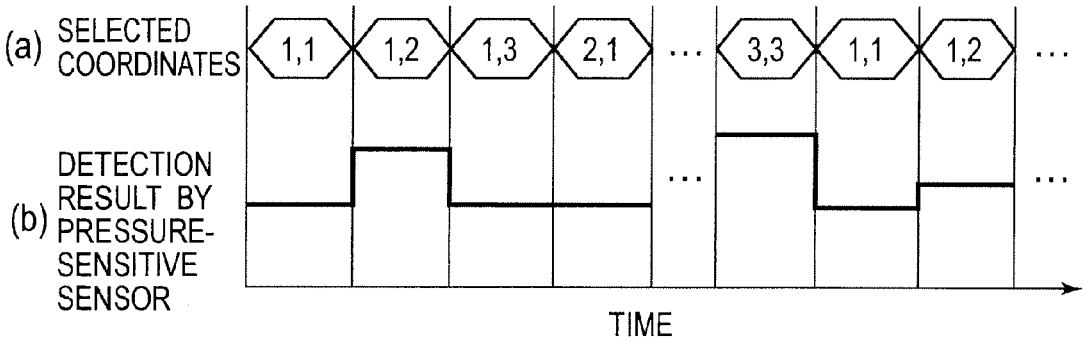
FIG. 8 is a timing chart showing how the matrix-patterned cloth of the second embodiment of the present invention works.

Next, referring to a timing chart shown in FIG. 8, descriptions will be provided for how the matrix-patterned cloth 21 of the second embodiment works.

FIG. 8 is an explanatory diagram showing an example of a result of detecting the pressure when the matrix-patterned cloth 21 is made to function as the pressure-sensitive sensor. As shown in FIG. 8 (*a*), the pressure detection controller 11 sequentially selects each of the coordinates from the coordinates (1, 1) through to the coordinates (3, 3) and applies a voltage thereto; measures currents flowing at this time; and finds the resistances R for the intersecting areas corresponding to the respective sets of coordinates on the basis of the relationship between the current and the voltage. Thereafter, the pressure detection controller 11 finds the lengths L on the basis of the resistances R thus found, and finds the pressures P by use of Equation (1) which has been described above.

Furthermore, in the case where pressure is applied to, for example, the coordinates (1, 2) and the coordinates (3, 3), the pressures are detected as shown in FIG. 8 (*b*) when the coordinates (1, 2) and the coordinates (3, 3) are selected. This makes it possible to detect locations (positions of the regions) in the entire region of the cloth portion 9 to which the pressure is applied, and how large the applied pressure is.

As described above, in the matrix-patterned cloth 21 of the second embodiment, the cloth portion 9 as a whole is divided into the multiple columns (the three columns in the embodiment) and the multiple rows (the three rows in the embodiment), the areas in which selected columns and selected rows intersect one another are defined as the intersecting areas, and the connecting yarns 43 provided in the selected intersecting areas are sequentially supplied with electric current. Moreover, depending on how large the pressure applied to the cloth portion 9 is, the positions of the contact points between the connecting yarns 43 and the conductive parts 4*a* to 4*c* in the upper layer 2, and/or the positions of the contact points between the connecting yarns 43 and the conductive parts 42*a* to 42*c* in the lower layer 3 change, and the resistances R between the contact points in the upper layer 2 and the contact points in the lower layer 3 accordingly change. For these reasons, the pressure P [Pa] can be calculated on the basis of the resistances R found from the relationship between the voltage and the current at the time of current application. Accordingly, it is possible to detect the partial (local) pressure applied to the cloth portion 9, and to make the matrix-patterned cloth 21 function as the pressure-sensitive sensor.

The foregoing descriptions have been provided for the embodiment in which: the three conductive parts 4*a* to 4*c* are provided in the upper layer 2; the three conductive parts 42*a* to 42*c* are provided in the lower layer 3; and the cloth portion 9 as a whole is divided into a matrix of three rows and three columns. However, the present invention is not limited to this embodiment. Multiple rows other than the three rows and multiple columns other than the three columns may be set in the matrix. Accuracy of the pressure detection increases as the number of defined intersecting areas becomes larger.

Third Embodiment

Next, descriptions will be provided for a third embodiment of the present invention. In the third embodiment, a matrix-patterned cloth is made to function as the pressure-sensitive sensor in the second embodiment so as to detect an area in the entire area of the cloth portion to which pressure is applied. In addition, the matrix-patterned cloth is made to function as a heater so as to heat the area to which the pressure is applied. Detailed descriptions will be provided below.

Figure 9:
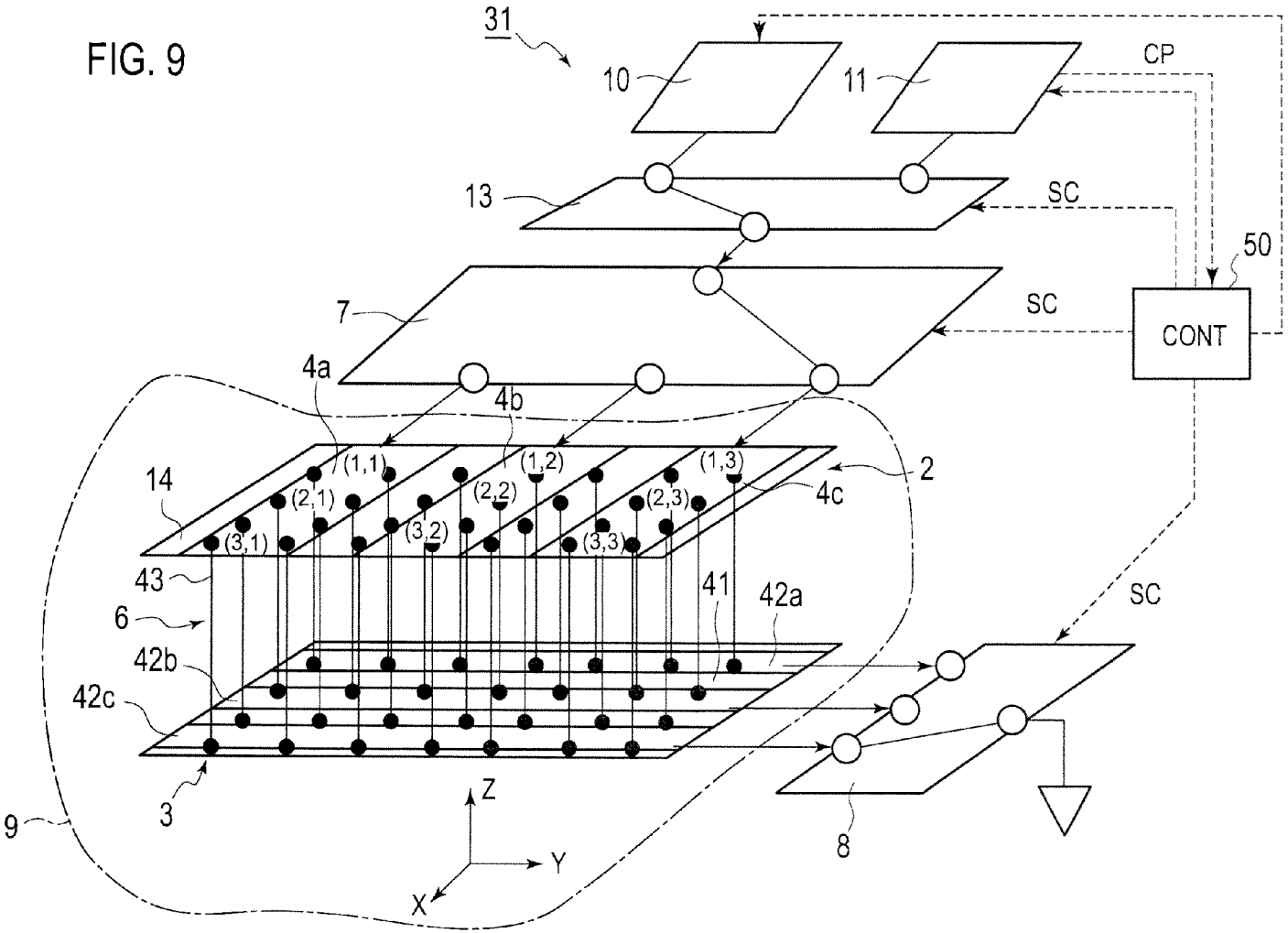
FIG. 9 is an exploded perspective view schematically showing a matrix-patterned cloth of a third embodiment of the present invention.

FIG. 9 is an exploded perspective view schematically showing a configuration of a matrix-patterned cloth 31 of the third embodiment of the present invention. As shown in FIG. 9, the matrix-patterned cloth 31 includes: the cloth portion 9; the column scan selector 7 configured to select a column position of an area on the cloth portion 9; the row scan selector 8 configured to select a row position of the area on the cloth portion 9; the pressure detection controller 11 configured to detect a pressure applied to the area selected by the column scan selector 7 and the row scan selector 8; and the heat generation controller 10 configured to output a voltage for heating a desired area out of the areas thus selected by the column scan selector 7 and the row scan selector 8. The matrix-patterned cloth 31 further includes an operation switching unit 13 configured to select either an output from the pressure detection controller 11 or an output from the heat generation controller 10.

Since the cloth portion 9 has the same configuration as the cloth portion 9 of the first embodiment (see FIG. 1) described above, the same components will be denoted by the same reference signs, and descriptions of the configuration will be omitted. In addition, since the column scan selector 7, the row scan selector 8, the pressure detection controller 11, and the heat generation controller 10 also have the same configurations as those of the first and second embodiments described above, descriptions of their configurations will be omitted.

On the basis of a control signal from the matrix-patterned cloth controller 50, the operation switching unit 13 alternately switches between the pressure detection controller 11 and the heat generation controller 10 at intervals of predetermined time.

Figure 10:
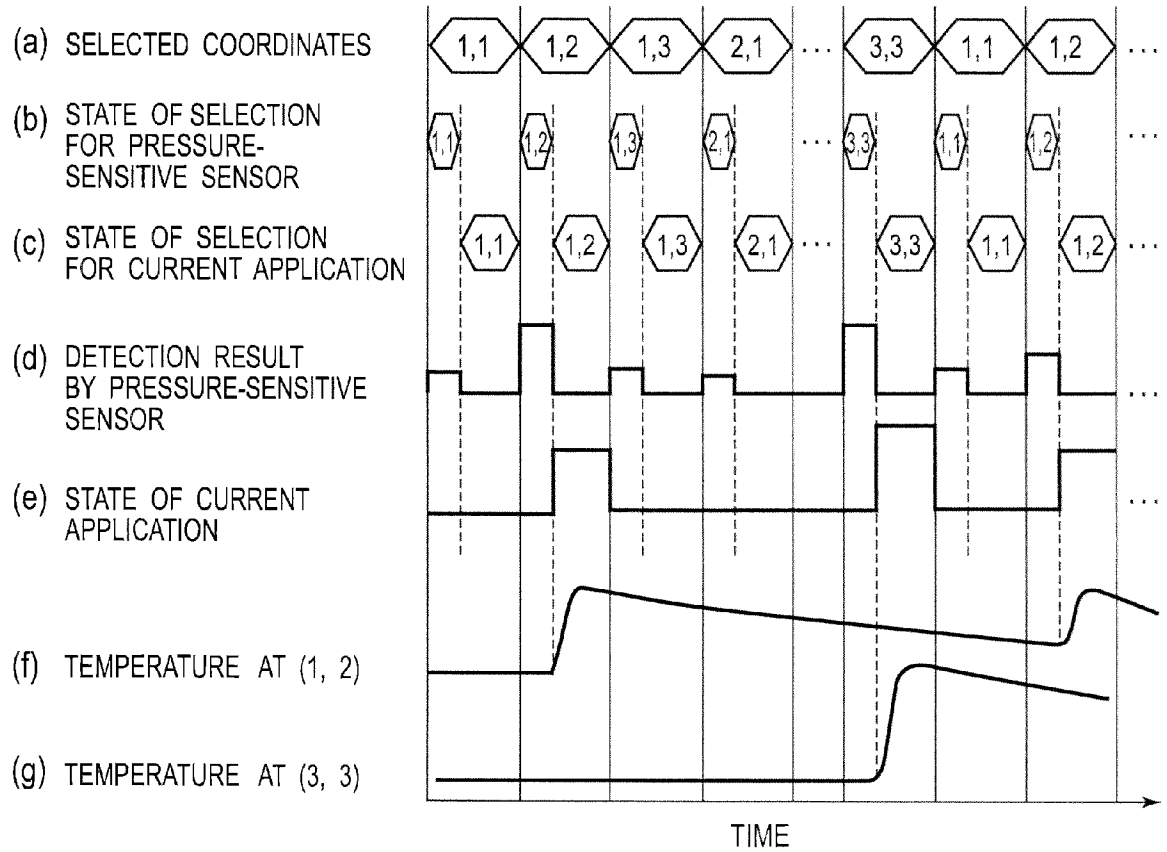
FIG. 10 is a timing chart showing how the matrix-patterned cloth of the third embodiment of the present invention works.

Next, referring to a timing chart shown in FIG. 10, descriptions will be provided for how the matrix-patterned cloth 31 of the third embodiment works.

FIG. 10 shows how the matrix-patterned cloth 31 works when: the matrix-patterned cloth 31 is made to function as the pressure-sensitive sensor so as to detect an area in the entire area of the cloth portion to which pressure is applied; and the matrix-patterned cloth 31 is made to function as the cloth heater so as to selectively heat the area to which the pressure is applied.

On the basis of the selection control signal SC supplied from the matrix-patterned cloth controller 50, the column scan selector 7 and the row scan selector 8 select (switch in a scanning manner) each of the coordinates sequentially from the coordinates (1, 1) through to the coordinates (3, 3), such that each coordinate is selected for a predetermined time interval (a first predetermined length of time). As such, the intersecting areas are selected one by one in the order of the coordinates (1, 1), the coordinates (1, 2), . . . , as shown in FIG. 10 (*a*). In addition, the operation switching unit 13 switches the connection of the cloth portion 9 between the pressure detection controller 11 and the heat generation controller 10 within each time period when a set of coordinates is selected. To put it specifically, as shown in FIGS. 10 (*b*) and (*c*), each length of time during which a set of coordinates is selected is divided into: a time slot (a second predetermined length of time) for detecting the pressure and a time slot (a third length of time) for the current application. Thus, during each interval of the first predetermined length of time, the second predetermined length of time and the third predetermined length of time are sequentially switched.

Furthermore, the heat generation controller 10 applies the voltage to any intersecting area out of the intersecting areas specified by the respective sets of coordinates, which is detected as an area where the pressure is applied, and thus supplies electric current to the connecting yarn 43 in the intersecting area to cause the connecting yarns 43 to generate heat. For example, when the pressure detection controller 11 detects pressures in the coordinates (1, 2) and the coordinates (3, 3) as shown in FIG. 10 (*d*), the intersecting areas corresponding to the coordinates (1, 2) and the coordinates (3, 3) are supplied with electric current and thus caused to generate heat as shown in FIG. 10 (*e*).

Consequently, the intersecting area corresponding to the coordinates (1, 2) is heated as shown in FIG. 10 (*f*), and the intersecting area corresponding to the coordinates (3, 3) is heated as shown in FIG. 10 (*g*). In this respect, the current to be supplied is increased as the value of the detected pressure is larger. Thereby, the amount of heat generation is increased and the resulting temperature at the time of heating is higher. To put it specifically, as shown in FIG. 10 (*d*), since the pressure applied to the coordinates (3, 3) is higher than that applied to the coordinates (1, 2), the current flowing through the coordinates (3, 3) is made larger than that flowing through the coordinates (1, 2) as shown in FIG. 10 (*e*). Thereby, the temperature in the coordinates (3, 3) is higher at the time of heating.

In short, the electric current to be supplied is controlled depending on the condition of pressure application, and the control is made such that the temperature becomes higher in an area to which higher pressure is applied. Incidentally, the control for making the temperature become higher in the area to which the higher pressure is applied may be achieved by setting a longer length of time for the current application to the area to which the higher pressure is applied.

Figure 12:
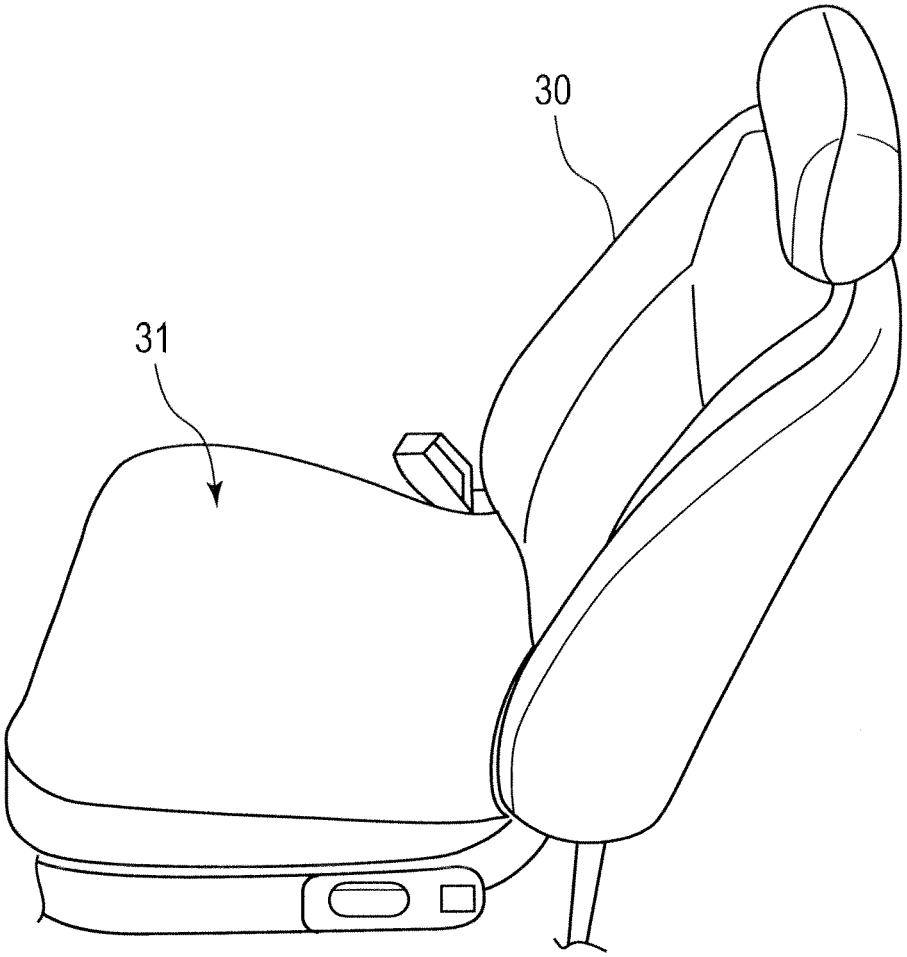
FIG. 12 is an explanatory diagram showing an example of how the matrix-patterned cloth of the present invention is installed in a vehicle sheet.

As described above, the matrix-patterned cloth 31 of the third embodiment sequentially detects the pressure on each of the intersecting areas corresponding to the coordinates (1, 1) through to the coordinates (3, 3) which are selected by combining the conductive parts 4*a* to 4*c* in the upper layer 2 with the conductive parts 42*a* to 42*c* in the lower layer 3; applies the voltage to any intersecting area in which the pressure is detected; and thereby heats only the intersecting area in which the pressure is detected. For this reason, in the case where the matrix-patterned cloth 31 is installed in a vehicle seat 30 as shown in FIG. 12, for example, the areas to which the pressure is applied by a passenger can be selectively heated. Thereby, the temperature can be controlled in a manner suitable for the passenger. In addition, since the areas in which no pressure is detected are not heated, power consumption can be reduced.

Furthermore, the intersecting areas are selected one by one in time series; during each selection interval (the first predetermined length of time) when one intersecting area is selected, the pressure-application condition is checked in the intersecting area (for the second predetermined length of time); and if the pressure is detected, the intersecting area is heated (for the third predetermined length of time). For this reason, it is possible to reduce the number of switching operations by the column scan selector 7 and the raw scan selector 8, and accordingly to enhance the controllability.

Moreover, since the amount of the current or the length of time for the current application is controlled depending on how large the detected pressure is (the pressure-application condition), the heating can be controlled depending on how large the pressure is.

Figure 11:
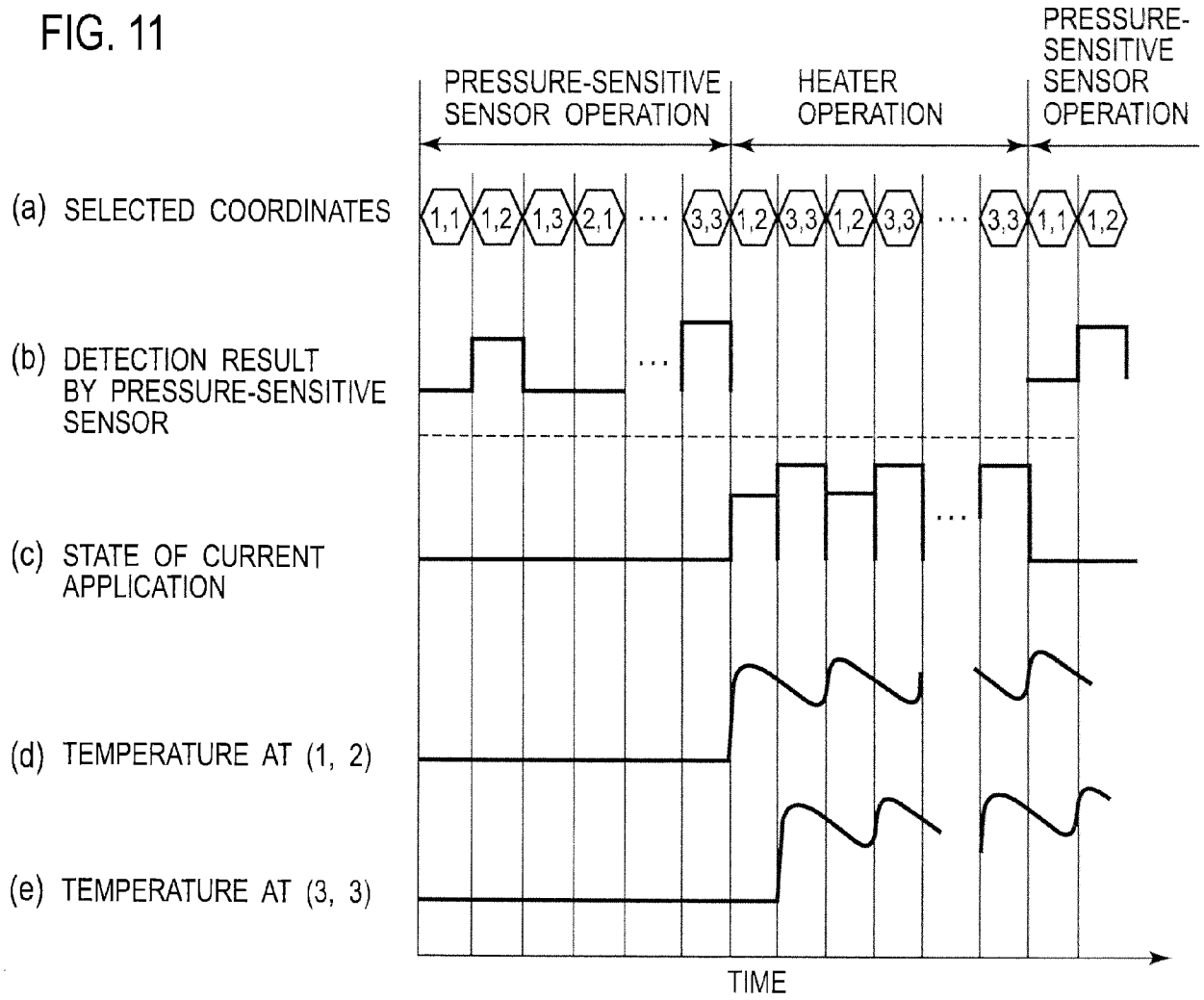
FIG. 11 is a timing chart showing how a matrix-patterned cloth of a modification of the third embodiment of the present invention works.

Next, descriptions will be provided for a modification of the third embodiment. FIG. 11 is a timing chart showing how the matrix-patterned cloth 31 of the modification works. In this modification, as shown in FIG. 11 (*a*), initially the matrix-patterned cloth 31 is made to function only as the pressure-sensitive sensor so as to detect the areas to which pressure is applied out of the corresponding coordinates (1, 1) through to coordinates (3, 3).

Thereafter, if pressures are detected in the coordinates (1, 2) and the coordinates (3, 3) as shown in FIG. 11 (*b*), for example, the intersecting areas corresponding to the coordinates (1, 2) and the coordinates (3, 3) are supplied with electric current and heated as shown in FIG. 11 (*c*). Consequently, the temperature of the intersecting area corresponding to the coordinates (1, 2) rises as shown in FIG. 11 (*d*), and the temperature of the intersecting area corresponding to the coordinates (3, 3) rises as shown in FIG. 11 (*e*).

In this manner, the matrix-patterned cloth 31 of the modification is capable of selectively heating only the areas in which the pressures are detected in the entire cloth portion 9, as in the case of the third embodiment shown in FIG. 10. For this reason, when installed in the vehicle seat 30, the matrix-patterned cloth 31 of the modification heats the areas to which the pressures are applied by the passenger, but does not heat the other areas. Accordingly, the matrix-patterned cloth 31 of the modification can reduce power consumption.

It should be noted that the heat generation controller 10, the pressure detection controller 11, and the matrix-patterned cloth controller 50 are formed from, for example, a computer including an operation unit, a storage unit, an input unit, and an output unit. The matrix-patterned cloth controller 50 controls the heat generation controller 10, the pressure detection controller 11, the column scan selector 7, the row scan selector 8, the operation switching unit 13, and the like in block. The functions of the heat generation controller 10, the pressure detection controller 11, and the matrix-patterned cloth controller 50 are realized by the operation unit executing programs stored in the storage unit. The programs, for example, are those provided for causing the heat generation controller 10, the pressure detection controller 11, the column scan selector 7, the row scan selector 8, the operation switching unit 13, and the like to execute the procedures for making the matrix-patterned cloth perform the operations shown in the timing charts of FIGS. 2, 3, 8, 10, and 11.

Although the foregoing descriptions have been provided for the embodiments of the present invention, these embodiments are mere examples described for facilitating the understandings of the present invention, and the present invention is not limited to the embodiments. The technical scope of the present invention is not limited to the concrete technical matters which have been disclosed in the embodiments, but includes various modifications, changes, alternative techniques, and the like which can be easily derived from the disclosed technical matters.

For example, although the foregoing descriptions have been provided for the embodiments in which the matrix-patterned cloth is installed in the vehicle seat, the present invention is not limited to these embodiments. When the matrix-patterned cloth is used as a bed sheet in a hospital, a nursing home or the like, the matrix-patterned cloth also can be used for the purpose of warming only a specific region of the matrix-patterned cloth while detecting the area to which pressure is applied.

What is more, although the foregoing descriptions have been provided for the embodiments in which the intersecting areas are arranged in the form of a matrix of three columns and three rows, the present invention is not limited to these embodiments. The present invention can be carried out with the intersecting areas arranged in the form of any matrix of multiple columns and multiple rows.

This application claims the benefit of priority from Japanese Patent Application No. 2012-155515, filed on Jul. 11, 2012, the entire contents of which are incorporated herein by reference.

The invention claimed is:

1. A matrix-patterned cloth comprising:

a first fiber layer including a plurality of first electric conductors arranged respectively in a plurality of selected first regions in the first fiber layer, and a first insulating part having an electrically insulating property and arranged in a region other than the first regions in the first fiber layer;

a second fiber layer including a plurality of second electric conductors arranged respectively in a plurality of selected second regions in the second fiber layer, and a second insulating part having an electrically insulating property and arranged in a region other than the second regions in the second fiber layer;

an intermediate fiber layer arranged between the first fiber layer and the second fiber layer, and having a surface in contact with the first fiber layer and a surface in contact with the second fiber layer;

a plurality of conductive connecting yarns extending from the surface of the intermediate fiber layer in contact with the first fiber layer to the surface of the intermediate fiber layer in contact with the second fiber layer, and each connecting yarn connecting at least one of the plurality of first electric conductors and at least one of the plurality of second electric conductors, wherein each of the plurality of connecting yarns is arranged such that the connecting yarn bends when a pressure is applied to the matrix-patterned cloth in a thickness direction thereof, and such that at least one of a position of contact between the connecting yarn and the corresponding first electric conductor, and, a position of contact between the connecting yarn and the corresponding second electric conductor, changes depending on how large the pressure is;

a selector configured to scan and sequentially select at least one of the plurality of first electric conductors and at least one of the plurality of second electric conductors, and to set areas, in which the selected first electric conductors and the selected second electric conductors intersect each other when viewed in the thickness direction, as intersecting areas; and at least one of a heating controller and a resistance measuring unit, the heating controller configured to apply a voltage to the intersecting areas via the first and second electric conductors selected by the selector, and the resistance measuring unit configured to measure electric resistances of the intersecting areas via the first and second electric conductors selected by the selector.

2. The matrix-patterned cloth of claim 1, wherein the plurality of first electric conductors and the plurality of second electric conductors each has a belt shape and arranged in a direction in which each of the plurality of second electric conductors intersects the plurality of first electric conductors when viewed in the thickness direction.

3. The matrix-patterned cloth of claim 2, further comprising a pressure-application condition detector configured to sequentially detect pressure-application conditions of the intersecting areas in which the first electric conductors and the second electric conductors selected by the selector intersect each other, on the basis of the electric resistances measured by the resistance measuring unit, wherein the heating controller supplies electric current to the first electric conductors and the second electric conductors corresponding to the intersecting areas in which application of pressures is detected by the pressure-application condition detector, and causes the connecting yarns corresponding to the intersecting areas to generate heat.

4. The matrix-patterned cloth of claim 3, wherein for each of the intersecting areas, the selector sets a time for selecting the intersecting area as a first predetermined length of time, and divides the first predetermined length of time into a second predetermined length of time and a third predetermined length of time, the pressure-application condition detector detects the pressure-application condition of the intersecting area during the second predetermined length of time, and the heating controller causes the connecting yarn corresponding to the intersecting area in which application of pressures is detected to generate heat during the third predetermined length of time.

5. The matrix-patterned cloth of claim 3, wherein in accordance with the pressure-application condition detected by the pressure-application condition detector, the heating controller controls at least one of an amount of current or a length of time for current application when the first electric conductors and the second electric conductors are supplied with electric current.

6. The matrix-patterned cloth of claim 1, wherein the selector sequentially scans and selects one of the plurality of first electric conductors and one of the plurality of second electric conductors, and sets an area, in which the selected first electric conductor and the selected second electric conductor intersect each other when viewed in the thickness direction, as the intersecting area, and wherein the matrix-patterned cloth further comprises a pressure-application condition detector configured to detect a pressure-applied intersecting area out of the intersecting areas on the basis of the electric resistance measured by the resistance measuring unit.

7. The matrix-patterned cloth of claim 1, wherein each connecting yarn is made of a conductive polymer fiber.

8. The matrix-patterned cloth of claim 7, wherein the conductive polymer fiber includes a semiconductor.

9. The matrix-patterned cloth of claim 7, wherein the conductive polymer fiber includes a conductive polymer.

10. The matrix-patterned cloth of claim 7, wherein the conductive polymer fiber includes carbon.

11. The matrix-patterned cloth of claim 7, wherein the conductive polymer fiber is a conductive fiber coated with another polymer.

12. The matrix-patterned cloth of claim 7, wherein the conductive polymer fiber is a fiber coated with a conductor.

13. The matrix-patterned cloth of claim 7, wherein an electrical resistivity of the conductive polymer fiber is in a range of $10^{-3}$ to $10^{2}$ Ω·cm.

14. A method of heating a matrix-patterned cloth, comprising:

providing a matrix-patterned cloth comprising:

a first fiber layer including a plurality of first electric conductors arranged respectively in a plurality of selected first regions in the first fiber layer, and a first insulating part having an electrically insulating property and arranged in a region other than the first regions in the first fiber layer;

a second fiber layer including a plurality of second electric conductors arranged respectively in a plurality of selected second regions in the second fiber layer, and a second insulating part having an electrically insulating property and arranged in a region other than the second regions in the second fiber layer;

an intermediate fiber layer arranged between the first fiber layer and the second fiber layer, and having a surface in contact with the first fiber layer and a surface in contact with the second fiber layer; and a plurality of conductive connecting yarns extending from the surface of the intermediate fiber layer in contact with the first fiber layer to the surface of the intermediate fiber layer in contact with the second fiber layer, and each connecting yarn connecting at least one of the plurality of first electric conductors and at least one of the plurality of second electric conductors, wherein each of the plurality of connecting yarns is arranged such that the connecting yarn bends when a pressure is applied to the matrix-patterned cloth in a thickness direction thereof, and such that at least one of a position of contact between the connecting yarn and the corresponding first electric conductor, and, a position of contact between the connecting yarn and the corresponding second electric conductor, changes depending on how large the pressure is;

scanning and sequentially selecting at least one of the plurality of first electric conductors and at least one of the plurality of second electric conductors;

setting areas, in which the selected first electric conductors and the selected second electric conductors intersect each other when viewed in the thickness direction, as intersecting areas; and applying a voltage to the intersecting areas via the selected first and second electric conductors.

15. A matrix-patterned cloth comprising:

a first fiber layer including a plurality of first electric conductors arranged respectively in a plurality of selected first regions in the first fiber layer, and a first insulating part having an electrically insulating property and arranged in a region other than the first regions in the first fiber layer;

a second fiber layer including a plurality of second electric conductors arranged respectively in a plurality of selected second regions in the second fiber layer, and a second insulating part having an electrically insulating property and arranged in a region other than the second regions in the second fiber layer;

an intermediate fiber layer arranged between the first fiber layer and the second fiber layer, and having a surface in contact with the first fiber layer and a surface in contact with the second fiber layer;

a plurality of conductive connecting yarns extending from the surface of the intermediate fiber layer in contact with the first fiber layer to the surface of the intermediate fiber layer in contact with the second fiber layer, and each connecting yarn connecting at least one of the plurality of first electric conductors and at least one of the plurality of second electric conductors, wherein each of the plurality of connecting yarns is arranged such that the connecting yarn bends when a pressure is applied to the matrix-patterned cloth in a thickness direction thereof, and such that at least one of a position of contact between the connecting yarn and the corresponding first electric conductor, and, a position of contact between the connecting yarn and the corresponding second electric conductor, changes depending on how large the pressure is;

selecting means for scanning and sequentially selecting at least one of the plurality of first electric conductors and at least one of the plurality of second electric conductors, the selecting means setting areas, in which the selected first electric conductors and the selected second electric conductors intersect each other when viewed in the thickness direction, as intersecting areas; and at least one of means for applying a voltage to the intersecting areas via the first and second electric conductors selected by the selecting means, and means for measuring electric resistances of the intersecting areas via the first and second electric conductors selected by the selecting means.

* * * * *